US007797953B2

(12) United States Patent
Yokoi

(10) Patent No.: US 7,797,953 B2
(45) Date of Patent: Sep. 21, 2010

(54) AIR CONDITIONING SYSTEM AND CONTROLLER FOR THE SAME

(75) Inventor: Masahito Yokoi, Tokyo (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 352 days.

(21) Appl. No.: 11/847,086

(22) Filed: Aug. 29, 2007

(65) Prior Publication Data

US 2008/0053122 A1 Mar. 6, 2008

(30) Foreign Application Priority Data

Aug. 31, 2006 (JP) ..... 2006-236786

(51) Int. Cl.
*F25B 29/00* (2006.01)

(52) U.S. Cl. ..... 62/159; 62/175; 62/199

(58) Field of Classification Search ..... 62/159, 62/175, 199, 200; 700/276, 277, 278
See application file for complete search history.

(56) References Cited

U.S. PATENT DOCUMENTS 4,809,154 A * 2/1989 Newton ..... 700/28
5,207,070 A * 5/1993 Miyazaki ..... 62/160
5,265,436 A * 11/1993 Murata et al. ..... 62/175
5,279,458 A * 1/1994 DeWolf et al. ..... 236/47
5,323,617 A * 6/1994 Ichikawa ..... 62/129
5,383,336 A * 1/1995 Nishida et al. ..... 62/115
5,522,230 A * 6/1996 Shima et al. ..... 62/127
5,647,223 A * 7/1997 Wada et al. ..... 62/175
5,853,123 A * 12/1998 Okano et al. ..... 236/51
6,044,652 A * 4/2000 Nishihara et al. ..... 62/175
7,082,353 B2 * 7/2006 Kwon et al. ..... 700/277
7,340,909 B2 * 3/2008 Kwon et al. ..... 62/175
7,523,619 B2 * 4/2009 Kojima et al. ..... 62/132
2002/0029096 A1 * 3/2002 Takai et al. ..... 700/276
2003/0014985 A1 * 1/2003 Dresens et al. ..... 62/149
2004/0117069 A1 * 6/2004 Yoon et al. ..... 700/276
2005/0204758 A1 * 9/2005 Kwon et al. ..... 62/175
2006/0219799 A1 * 10/2006 Schultz et al. ..... 236/1 C
2006/0287774 A1 * 12/2006 Yoon et al. ..... 700/276

FOREIGN PATENT DOCUMENTS

JP 2804527 B2 7/1998
JP 2006029693 A * 2/2006

* cited by examiner

*Primary Examiner*—George Nguyen
(74) *Attorney, Agent, or Firm*—Westerman, Hattori, Daniels & Adrian, LLP

(57) ABSTRACT

An air conditioning system equipped with at least one first air conditioning system in which an outdoor unit is connected to plural indoor units through an inter-unit pipe and the plural indoor units are allowed to execute one of cooling operation and heating operation concurrently, at least one second air conditioning system in which an outdoor unit is connected to plural indoor units through an inter-unit pipe and the plural indoor units are allowed to execute both cooling operation and heating operation in mixture concurrently, and a controller that is connected to the first and second air conditioning systems through a communication line so that communications can be performed between the controller and each of the first and second air conditioning systems, wherein the controller transmits a switching instruction signal for instructing switching of an air conditioning operation to cooling operation or heating operation through the communication line to the first and second air conditioning systems all together.

8 Claims, 4 Drawing Sheets

FIG.3

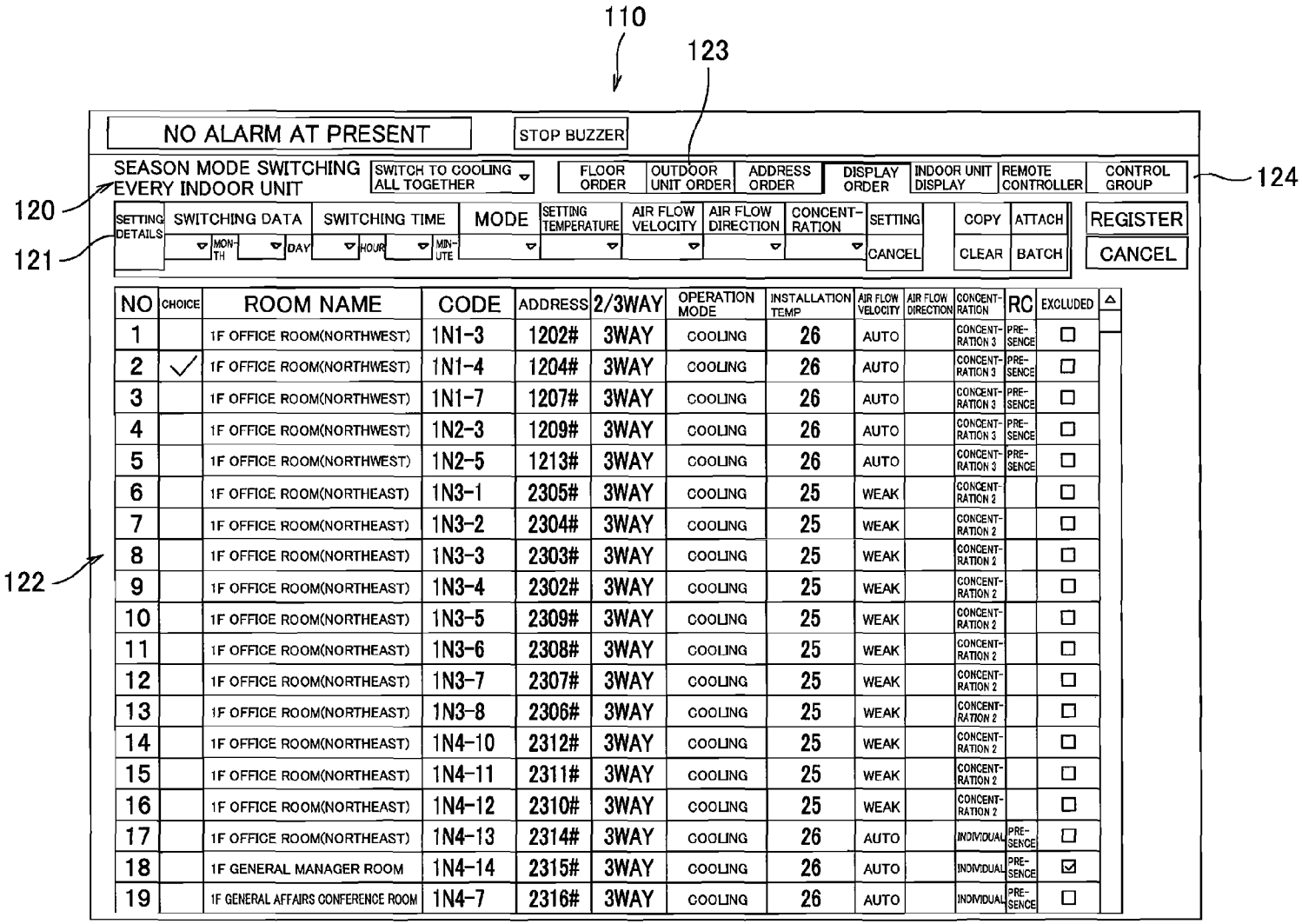

| NO | CHOICE | ROOM NAME | CODE | ADDRESS | 2/3WAY | OPERATION MODE | INSTALLATION TEMP | AIR FLOW VELOCITY | AIR FLOW DIRECTION | CONCENT-RATION | RC | EXCLUDED |
|---|---|---|---|---|---|---|---|---|---|---|---|---|
| 1 | | 1F OFFICE ROOM(NORTHWEST) | 1N1-3 | 1202# | 3WAY | COOLING | 26 | AUTO | | CONCENT-RATION 3 | PRE-SENCE | ☐ |
| 2 | ✓ | 1F OFFICE ROOM(NORTHWEST) | 1N1-4 | 1204# | 3WAY | COOLING | 26 | AUTO | | CONCENT-RATION 3 | PRE-SENCE | ☐ |
| 3 | | 1F OFFICE ROOM(NORTHWEST) | 1N1-7 | 1207# | 3WAY | COOLING | 26 | AUTO | | CONCENT-RATION 3 | PRE-SENCE | ☐ |
| 4 | | 1F OFFICE ROOM(NORTHWEST) | 1N2-3 | 1209# | 3WAY | COOLING | 26 | AUTO | | CONCENT-RATION 3 | PRE-SENCE | ☐ |
| 5 | | 1F OFFICE ROOM(NORTHWEST) | 1N2-5 | 1213# | 3WAY | COOLING | 26 | AUTO | | CONCENT-RATION 3 | PRE-SENCE | ☐ |
| 6 | | 1F OFFICE ROOM(NORTHEAST) | 1N3-1 | 2305# | 3WAY | COOLING | 25 | WEAK | | CONCENT-RATION 2 | | ☐ |
| 7 | | 1F OFFICE ROOM(NORTHEAST) | 1N3-2 | 2304# | 3WAY | COOLING | 25 | WEAK | | CONCENT-RATION 2 | | ☐ |
| 8 | | 1F OFFICE ROOM(NORTHEAST) | 1N3-3 | 2303# | 3WAY | COOLING | 25 | WEAK | | CONCENT-RATION 2 | | ☐ |
| 9 | | 1F OFFICE ROOM(NORTHEAST) | 1N3-4 | 2302# | 3WAY | COOLING | 25 | WEAK | | CONCENT-RATION 2 | | ☐ |
| 10 | | 1F OFFICE ROOM(NORTHEAST) | 1N3-5 | 2309# | 3WAY | COOLING | 25 | WEAK | | CONCENT-RATION 2 | | ☐ |
| 11 | | 1F OFFICE ROOM(NORTHEAST) | 1N3-6 | 2308# | 3WAY | COOLING | 25 | WEAK | | CONCENT-RATION 2 | | ☐ |
| 12 | | 1F OFFICE ROOM(NORTHEAST) | 1N3-7 | 2307# | 3WAY | COOLING | 25 | WEAK | | CONCENT-RATION 2 | | ☐ |
| 13 | | 1F OFFICE ROOM(NORTHEAST) | 1N3-8 | 2306# | 3WAY | COOLING | 25 | WEAK | | CONCENT-RATION 2 | | ☐ |
| 14 | | 1F OFFICE ROOM(NORTHEAST) | 1N4-10 | 2312# | 3WAY | COOLING | 25 | WEAK | | CONCENT-RATION 2 | | ☐ |
| 15 | | 1F OFFICE ROOM(NORTHEAST) | 1N4-11 | 2311# | 3WAY | COOLING | 25 | WEAK | | CONCENT-RATION 2 | | ☐ |
| 16 | | 1F OFFICE ROOM(NORTHEAST) | 1N4-12 | 2310# | 3WAY | COOLING | 25 | WEAK | | CONCENT-RATION 2 | | ☐ |
| 17 | | 1F OFFICE ROOM(NORTHEAST) | 1N4-13 | 2314# | 3WAY | COOLING | 26 | AUTO | | INDIVIDUAL | PRE-SENCE | ☐ |
| 18 | | 1F GENERAL MANAGER ROOM | 1N4-14 | 2315# | 3WAY | COOLING | 26 | AUTO | | INDIVIDUAL | PRE-SENCE | ☑ |
| 19 | | 1F GENERAL AFFAIRS CONFERENCE ROOM | 1N4-7 | 2316# | 3WAY | COOLING | 26 | AUTO | | INDIVIDUAL | PRE-SENCE | ☐ |

AIR CONDITIONING SYSTEM AND CONTROLLER FOR THE SAME

INCORPORATION BY REFERENCE

The present application claims priority under 35 U.S.C. §119 to Japanese Patent Application No. 2006-236786 filed on Aug. 31, 2006. The content of the application is incorporated herein by reference in its entirety.

BACKGROUND OF THE INVENTION

1. Field of the Invention

The present invention relates to an air conditioning system installed in a large-scale building or the like, and a controller for the air conditioning system.

2. Description of the Related Art

There are generally known an air conditioning system in which an outdoor unit and plural indoor units are connected to one another through an inter-unit pipe comprising a high-pressure gas pipe, a low pressure gas pipe and a liquid pipe so that the plural indoor units can perform cooling operation or heating operation at the same time (hereinafter referred to as "2-way air conditioning system"), and also an air conditioning system in which both heating operation and cooling operation can be performed in a mixing style (hereinafter referred to as "3-way air conditioning system") (see Japanese Patent No. 2,804,527.

In a relatively large-scale building such as a commercial building, a hospital or the like, a large number of air conditioning systems as described above are used in combination because the number of rooms is increased, thereby constructing a large-scale air conditioning system having several hundreds to one thousand or more (hereinafter referred to as "multiple air conditioning system for buildings") to air-condition each room in the building.

The switching operation between the cooling operation and the heating operation is carried out every outdoor unit in the 2-way air conditioning system and every indoor unit in the 3-way air conditioning system. Therefore, it is impossible to switch the air conditioning operations of the respective rooms in the building all together at the turn of the seasons or the like.

SUMMARY OF THE INVENTION

Therefore, the present invention has been implemented in view of the foregoing situation, and has an object of the present invention is to provide an air conditioning system that can perform switching of cooling operation or heating operation all together, and a controller for the air conditioning system.

In order to attain the above object, according to an aspect of the present invention, there is provided an air conditioning system comprising: at least one first air conditioning system in which an outdoor unit is connected to plural indoor units through an inter-unit pipe and the plural indoor units are allowed to execute one of cooling operation and heating operation concurrently; at least one second air conditioning system in which an outdoor unit is connected to plural indoor units through an inter-unit pipe and the plural indoor units are allowed to execute both cooling operation and heating operation in mixture concurrently; and a controller that is connected to the first and second air conditioning systems through a communication line so that communications can be performed between the controller and each of the first and second air conditioning systems, wherein the controller transmits a switching instruction signal for instructing switching of an air conditioning operation to cooling operation or heating operation through the communication line to the first and second air conditioning systems all together.

In the above air conditioning system, the controller may be quipped with a date registering unit for registering, on the controller, a date at which the switching instruction signal is transmitted to switch the air conditioning operation to cooling operation or heating operation.

In the above air conditioning system, the controller may be equipped with an exclusion unit registering unit for registering, on the controller, indoor units to be excluded from target units of the first and second air conditioning systems which should be subjected to the air condition switching to cooling operation or heating operation on the basis of the switching instruction signal.

In the above air conditioning system, the air conditioning system may have a plurality of first air conditioning systems, and the controller may be equipped with a registering unit for registering, on the controller, first air conditioning systems to be excluded from target air conditioning systems which should be subjected to the air condition switching to cooling operation or heating operation on the basis of the switching instruction signal, every outdoor unit of the first air conditioning system.

In the above air conditioning system, the controller may be equipped with a storage unit for storing a plurality of indoor unit groups achieved by dividing the indoor units of the second air conditioning system every plural indoor units, and a registering unit for registering, on the controller, indoor unit groups to be excluded from target indoor unit groups which should be subjected to the air condition switching to cooling operation or heating operation on the basis of the switching instruction signal, every indoor unit group.

In the above air conditioning system, the controller may be equipped with a storage unit for storing an installation place of each indoor unit of the first and second air conditioning systems in advance, and a registering unit for registering, on the controller on the basis of the installation place, an indoor unit to be excluded from target indoor units which should be subjected to the air conditioning switching to cooling operation or heating operation on the basis of the switching instruction signal.

In the above air conditioning system, the controller may be equipped with a registering unit for registering on the controller at least one setting value of setting temperature, an air flow velocity, air flow direction and a concentrated control mode of each indoor unit, and the controller reflects the setting value to each indoor unit when the air conditioning operation is switched to the heating operation or the cooling operation.

According to another aspect of the present invention, there is provided a controller for an air conditioning system including at least one first air conditioning system in which an outdoor unit is connected to plural indoor units through an inter-unit pipe and the plural indoor units are allowed to execute one of cooling operation and heating operation concurrently, and at least one second air conditioning system in which an outdoor unit is connected to plural indoor units through an inter-unit pipe and the plural indoor units are allowed to execute both cooling operation and heating operation in mixture concurrently, the controller being connected to the first and second air conditioning systems through a communication line so that communications can be performed between the controller and each of the first and second air conditioning systems, and transmitting a switching instruction signal for instructing switching of an air conditioning operation to cooling operation or heating operation through the communication line to the first and second air conditioning systems all together.

According to the present invention, the air conditioning system is equipped with the controller for concurrently transmitting a switching instruction signal for instructing switching of the air conditioning operation to cooling operation or heating operation to the first air conditioning system in which one of the cooling operation and the heating operation (i.e., the same air-conditioning operation) can be concurrently performed by plural indoor units, and the second air conditioning system in which both the heating operation and the cooling operation (i.e., the different air-conditioning operations) are concurrently performed by the plural indoor units. Therefore, the switching operation to cooling operation or heating operation can be performed concurrently (all together) among the plural indoor units. Therefore, the work of switching the air conditioning operation at the turn of the seasons or the like can be facilitated.

BRIEF DESCRIPTION OF THE PREFERRED EMBODIMENT

FIG. 3 is a diagram showing an operation switching and setting screen; and

DETAILED DESCRIPTION OF THE PREFERRED EMBODIMENT

A preferred embodiment according to the present invention will be described with reference to the accompanying drawings.

Figure 1:
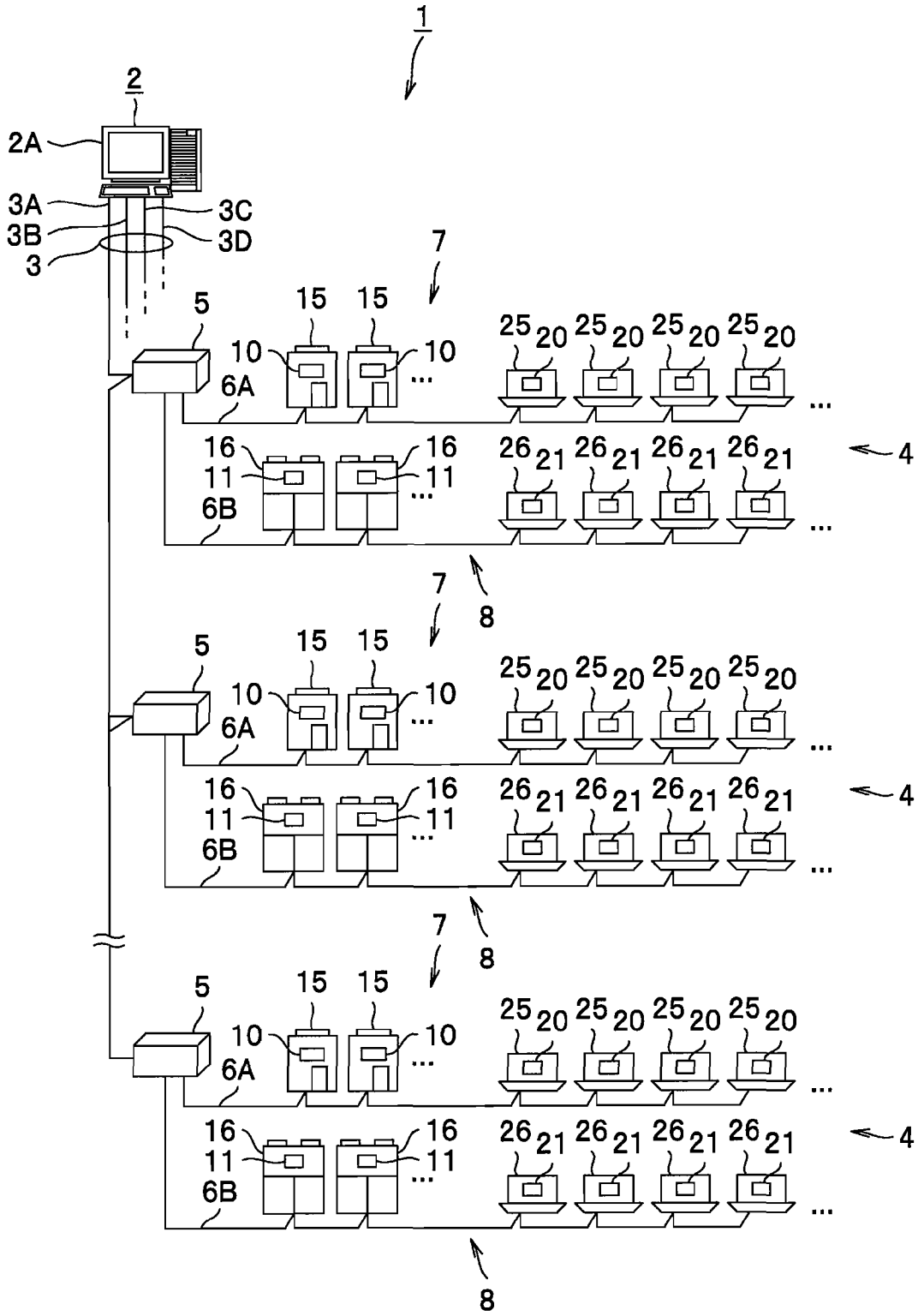
FIG. 1 is a schematic diagram showing the construction of a multiple air conditioning system for a building according to an embodiment of the present invention.

FIG. 1 is a diagram showing a multiple air conditioning system for a building as an air conditioning system according to an embodiment of the present invention. This multiple air conditioning system 1 is used to air-condition each room of a relatively-large scale building such as a commercial building, a hospital or the like, and it has a control computer 2 as a central control device and plural sub air conditioning systems 4 which are connected to the control computer 2 through a main communication line 3 so that communications can be performed therebetween.

The main communication line 3 has plural (four in FIG. 1) communication adaptor operating lines 3A to 3D, and communication adaptors 5 are connected to the communication adaptor operating lines 3A to 3D. The upper limit number of the communication adaptors is equal to 31, for example. Each sub air conditioning system 4 is connected to each communication adaptor 5. Each sub air conditioning system 4 has a 2-way air conditioning system 7 (first air conditioning system) and a 3-way air conditioning system 8 (second air conditioning system). The 2-way air conditioning system 7 is connected to each communication adaptor 5 through a sub communication line 6A, and the 3-way air conditioning system 8 is connected to each communication adaptor 5 through a sub communication line 6B, whereby the 2-way and 3-way air conditioning systems 7 and 8 can communicate with the control computer 2. It is needless to say that each sub air conditioning system 4 has only plural 2-way air conditioning systems or only plural 3-way air conditioning systems 8.

Here, the 2-way air conditioning system 7 is equipped with a plurality of (or one) outdoor units 15 each having a compressor and an outdoor heat exchanger and plural indoor units 25 each having an indoor heat exchanger which are connected to one another through an inter-unit pipe (not shown) comprising a high-pressure gas pipe, a low-pressure gas pipe and a liquid pipe. Under cooling operation, each outdoor unit 15 serves as a condenser and each indoor unit 25 serves as an evaporator. Conversely, under heating operation, each outdoor unit 15 serves as an evaporator, and each indoor unit 25 serves as a condenser, whereby the respective indoor units 25 can carry out cooling operation or heating operation at the same time.

Each outdoor unit 15 is provided with an outdoor control device 10. One of the outdoor control devices 10 serves as a master control device to control the other slave outdoor control devices 10. When the cooling operation or heating operation of each indoor unit 25 of the 2-way air conditioning system 7 is switched, the master outdoor control device 10 gives an operation switching instruction to the other slave outdoor control devices 10, whereby the four-way valves (not shown) of the respective outdoor units 15 are switched and the air conditioning operations of the outdoor units 15 are switched all together.

Furthermore, each indoor unit 25 is provided with an indoor control device 20, and each indoor control device 20 has a function of receiving an air conditioning request from a remote controller (not shown) set in a room and transmitting the air conditioning request through the sub communication line 6A to the outdoor control device 10.

The 3-way air conditioning system 8 has a plurality of (or one) outdoor units 16 each having a compressor and an outdoor heat exchanger, and a plurality of indoor units 26 each having an indoor heat exchanger which are connected to one another through an inter-unit pipe (not shown) comprising a high-temperature and high-pressure gas refrigerant pipe (discharging pipe), an intermediate-temperature and intermediate-pressure liquid refrigerant pipe (liquid pipe) and a low-temperature and low-pressure gas refrigerant pipe (suction pipe), whereby each indoor unit 26 can individually perform cooling operation or heating operation, and thus cooling operation and heating operation can be performed in mixture in the respective indoor units 26. Each outdoor unit 16 and each indoor unit 26 are connected to the sub communication line 6B, whereby the communications can be performed therebetween.

More specifically, each indoor unit 26 is provided with a first opening/closing valve for connecting the gas refrigerant pipe (discharge pipe) and the liquid refrigerant pipe (liquid pipe) to the indoor heat exchanger, and a second opening/closing valve for connecting the liquid refrigerant pipe (liquid pipe) and the gas refrigerant pipe (suction pipe) to the indoor heat exchanger. Under heating operation, the first opening/closing valve is set to an open state and the second opening/closing valve is set to a close state, whereby the indoor heat exchanger is connected to the discharge pipe and the liquid pipe and the indoor heat exchanger is made to function as a condenser. Under cooling operation, the first opening/closing valve is set to a close state and the second opening/closing valve is set to an open state, whereby the indoor heat exchanger is connected to the liquid pipe and the suction pipe and the indoor heat exchanger is made to function as an evaporator. In the 3-way air conditioning system 8, each indoor unit switches the open/close state of the first and second opening/closing valves, whereby the cooling operation or the heating operation can be individually performed every indoor unit.

At this time, which one of the evaporator and the condenser each outdoor unit 16 functions as is determined on the basis of the ratio of the number of the indoor units 26 carrying out cooling operation (cooling capacity) and the number of the indoor units 26 carrying out heating operation (heating capacity) in consideration of the operation efficiency. When the number of the indoor units 26 carrying out the cooling operation is larger than the number of the indoor units 26 carrying out the heating operation, each outdoor unit 16 functions as a condenser. Conversely, when the number of the indoor units 26 carrying out the cooling operation is smaller than the number of the indoor units 26 carrying out the heating operation, each outdoor unit 16 functions as an evaporator.

As in the case of the 2-way air conditioning system 7, each outdoor unit 16 is provided with an outdoor control device 11, and one of the outdoor control devices functions as a master outdoor control device to control the other slave outdoor control devices to make each outdoor unit 16 function as a condenser or an evaporator.

Each indoor unit 26 is provided with an indoor control device 21. Each indoor control device 21 has a function of receiving an air conditioning request from a remote controller (not shown) installed in the room to switch the open/close state of the first and second opening/closing valves and carry out cooling operation or heating operation, or transmitting a power request to the outdoor control device 11 through the sub communication line 6B.

The control computer 2 executes lump-switching control of the air-conditioning operation to the cooling operation or heating operation in the 2-way air conditioning system 7 and the 3-way air conditioning system 8 of each sub air conditioning system 4. The construction of the control computer 2 will be described in detail below.

Figure 2:
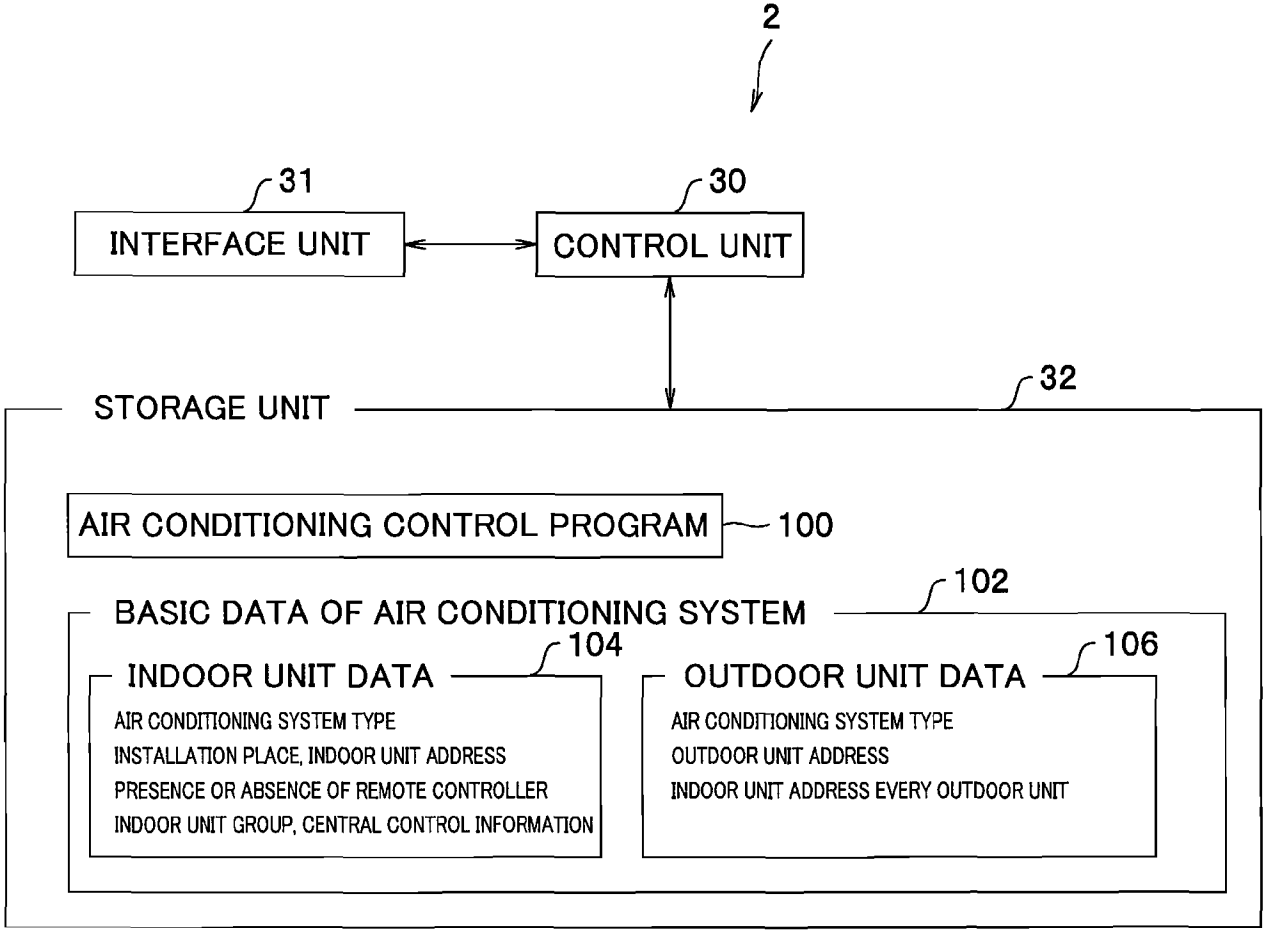
FIG. 2 is a diagram showing a function construction of a control computer.

FIG. 2 is a block diagram showing the functional construction of the control computer 2. As shown in FIG. 2, the control computer 2 is constructed by using a general computer system, and it has a controller 30 as a controlling/operating unit, an interface portion 31 as a connection interface of the main communication line 3 and a storage unit 32 for storing various kinds of programs and data.

The storage unit 32 contains an air condition control program 100 for controlling the switching of the air conditioning operation to cooling operation or heating operation in each sub air conditioning system 4, and air conditioning system basic data 102. The air conditioning system basic data 102 contain indoor unit data 104 as basic data of the respective indoor units 25 and 26 of the 2-way air conditioning system and the 3-way air conditioning system 8 of each sub air conditioning system 4, and outdoor unit data 106 as basic data of the respective outdoor units 15 and 16.

In the indoor unit data 104, the type of the air conditioning system (2-way or 3-way) to which each indoor unit 25, 26 belongs, the installation place (appellation or room name), the presence or absence of the remote controller (RC), the indoor unit address (inherent identification number), etc. are associated with one another every indoor unit, and further an indoor unit group is defined for the indoor units 26 belonging to the 3-way air conditioning system 8. The indoor unit group is used to collectively control plural indoor units 26 as a group, and an indoor address of indoor units 26 belonging to each group is registered every indoor unit group.

Furthermore, the indoor unit data 104 contains concentration control information (center control information) with which the control computer 2 controls specific settings (for example, setting of temperature setting, setting of air flow direction, setting of air flow amount, etc.) to the indoor units 25, 26 and the operation from the remote controller to the specific settings is prohibited. This concentration control information is classified into plural concentrated control modes in accordance with the kinds of the specific settings which are prohibited from being operated from the remote controller, and the concentrated control mode to which each indoor unit 25, 26 under concentrated control is classified is recorded.

Furthermore, the outdoor unit data 106 contains the type (2-way or 3-way) of the air conditioning system to which each outdoor unit 15, 16 belongs, an outdoor unit address (inherent identification number), and also an indoor unit address of each indoor unit 25 connected to the outdoor unit 15 in the case of the 2-way air conditioning system 7 are associated with one another every outdoor unit 15, 16.

Under the above construction, when the air conditioning operations of all the indoor units 25, 26 of the multiple air conditioning system 1 for buildings are collectively switched all together, the control computer 2 transmits a switching instruction signal to the cooling operation or the heating operation through the main communication line 3 to each outdoor unit 15 (or the outdoor unit 15 having the outdoor control device 10 serving as the master) of all the 2-way air conditioning systems 7 and each indoor unit 26 of all ht e3-way air conditioning systems 8. Accordingly, in the 2-way air conditioning systems 7, each outdoor unit 15 switches the four-way valve (not shown) or the like to switch the air conditioning operation of the indoor unit 25, and in the 3-way air conditioning systems 7, each indoor unit 26 switches the open/close states of the first and second opening/closing valves to switch the air-conditioning operation, whereby the air conditioning operations of all the indoor units 25, 26 of the multiple air conditioning system 1 for buildings are collectively switched all together.

An operation switching and setting screen 110 with a data inputting/registering unit is prepared as an user interface for switching the air conditioning operation, and this operation switching and setting screen 110 will be described with reference to FIG. 3. The operation switching and setting screen 110 is displayed on a monitor device 2A or the like which is equipped to the control computer 2, and it is provided with a concurrent switching instruction column 120 and a details setting column 121 as shown in FIG. 3.

The concurrent switching instruction column 120 is used to input an instruction of switching the air-conditioning operations of the respective indoor units 25, 26 concurrently or all together, and "concurrent switch to cooling (switch to cooling all together)" and "concurrent switch to heating (switch to heating all together)" can be selected.

The details setting column 121 is used to preset a switching date (month and day) and a switching time (hour and minute) of the air-conditioning operation. By registering the switching date and hour of the air conditioning operation (for example, turn of the seasons) into the details setting column 121 in advance through the data inputting/registering unit, the air conditioning operations of all the indoor units 25 and 26 of each sub air conditioning system 4 are changed to cooling operation or heating operation indicated in the concurrent switching instruction column 120 all together (or concurrently) at the switching date and hour concerned.

Furthermore, the details setting column 121 is provided with an air conditioning setting item column for setting the setting temperature, the air flow velocity (strong or weak under cooling/heating operation), the air flow direction (a tilt angle of a louver), etc., and by carrying out setting on the air conditioning setting item column, the air conditioning setting instruction is transmitted to the indoor units 25, 26 at the switching date and hour concerned, whereby the setting of the air conditioning setting item column is reflected to the indoor units 25 and 26.

In the above construction, the air conditioning operations of all the indoor units of the multiple air conditioning system 1 for buildings are switched all together (or concurrently). However, it is required to carry out cooling or heating at all times irrespectively of the season in such a room that the temperature must be kept constant at all times as in the case of a computer room, for example. Therefore, the operation switching and setting screen 110 is provided with an excluding unit setting column 122 for individually setting and registering indoor units 25, 26 which should be excluded from the air-conditioning operation switching control.

On the excluded unit setting column 122 are displayed room name (installation place), an indoor unit address, information indicating which one of the 2-way air conditioning system 7 and the 3-way air conditioning system 8 each indoor unit 25, 26 belongs to, setting temperature, the air flow velocity, the air flow direction, the presence or absence of the remote controller (RC), an exclusion check column, etc. every indoor unit 25, 26 while these data are associated with each other. By ticking the exclusion check column of an indoor unit 25, 26 to be excluded, the switching instruction signal for switching the air conditioning operation is not transmitted to the ticked indoor units 25, 26, and thus they are excluded from the switching control.

At this time, it is impossible in the 2-way air conditioning system 7 to exclude only some indoor units 25 as exclusion targets from the air condition control targets. Accordingly, all the indoor units 25 of the 2-way air conditioning system 7 to which the indoor units 25 as exclusion targets belong are specified on the basis of the outdoor unit data 106, and the exclusion check columns of these indoor units 25 are automatically ticked, whereby all the indoor units 25 concerned are set as exclusion targets. Accordingly, unconformity of setting can be prevented from occurring among the indoor units 25 belonging to the same 2-way air conditioning system 7.

Furthermore, in the 3-way air conditioning system 8, when some indoor units 26 of an indoor unit group as a control group are set as exclusion targets, all the other indoor units 26 of the indoor unit group to which the indoor units 26 as the exclusion targets belong are specified on the basis of the indoor unit data 104, and the exclusion check columns of these indoor units 26 are automatically ticked, so that these indoor units 26 are set as exclusion targets. Accordingly, the air conditioning operations of the respective indoor units 26 are switched concurrently (all together) while keeping the compliance of setting of the indoor units 26 in the indoor unit group as the control group.

Still furthermore, in the setting of excluding indoor units 25, 26 from the air condition switching control, the air conditioning operations of the indoor units to be excluded can be set on the details setting column 121. That is, the date of validating the exclusion from the air condition switching control (excluding date), the setting temperature of the indoor units 25, 26 to be excluded, the air flow velocity, the air flow direction, the concentrated control mode, etc. can be set on the details setting column 121.

Accordingly, the indoor units 25, 26 which are indicated to be excluded can be operated under the air conditioning operation preset on the details setting column 121 only at the exclusion date.

The operation switching and setting screen 110 is provided with an outdoor unit order button 123 for displaying, in the order of the outdoor units 15, 16, the indoor units 25, 26 to be displayed on the exclusion unit setting column 122, and a control group button 124 for displaying indoor units every indoor group.

Accordingly, for example, when all the indoor units of some 2-way air conditioning system 7 are excluded from the concurrent switching control, the outdoor unit order button 123 is selected, and the whole 2-way air conditioning system whose indoor unit 25 is disposed at a desired installation place can be efficiently excluded from the air conditioning operation switching control while checking the installation place of the indoor unit 25 concerned.

Likewise, when all the indoor units of some indoor unit group are excluded from the concurrent switching control, the control group button 124 is selected, and the whole indoor unit group whose indoor unit 26 is disposed at a desired installation place can be efficiently excluded from the air conditioning operation switching control while checking the installation place of each indoor unit 26 of the outdoor unit group concerned.

Figure 4:
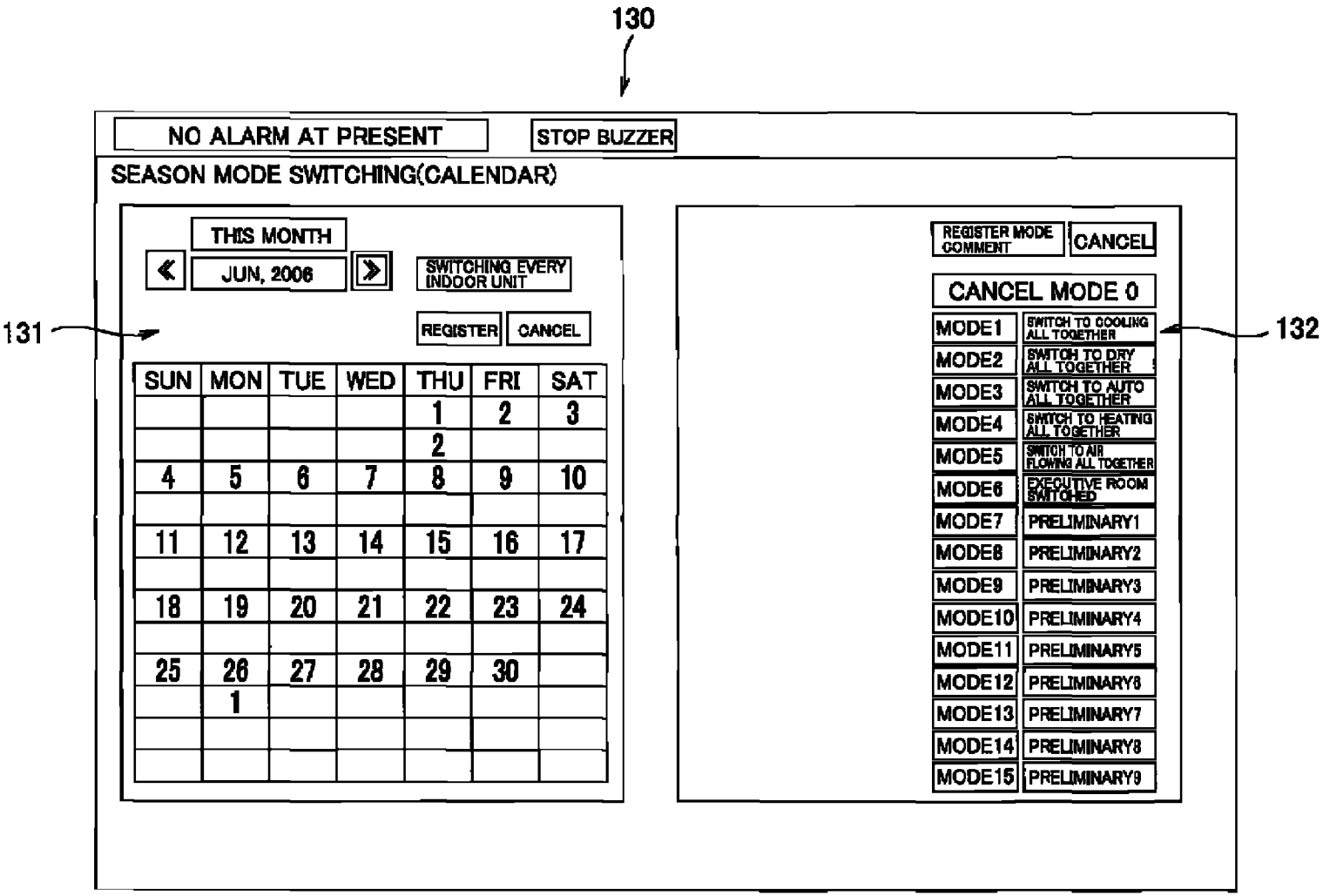
FIG. 4 is a diagram showing a mode setting screen.

Here, the details setting column 121 is provided with a mode indicating column for indicating a mode as a preset of the details setting. As shown in FIG. 4, this mode is set by operating the mode setting screen 130. The mode setting screen 130 is provided with a calendar 131 for setting a switching date, and an operation switching setting column 132 for indicating the air condition switching every plural modes. A desired mode is preset on the mode setting screen 130, whereby the preset is reflected by merely selecting the desired mode concerned on the details setting column 121, so that the setting can be facilitated.

Furthermore, each of the operation switching and setting screen 110 and the mode setting screen 130 is provided with a display column for reporting abnormality which occurs in the multiple air conditioning system 1 for buildings at present. Various kinds of abnormality information received from the respective outdoor units 15 and 16 and the respective indoor units 25, 26 through the main communication line 3 by the control computer 2 is displayed on the display column. When abnormality is displayed on this display column, the control computer 2 emits an alarm buzzer from a sound source device (not shown) to quickly notify occurrence of the abnormality to a worker.

As described above, according to this embodiment, the control computer 2 transmits the switching instruction signal for instructing the switching of the air conditioning operation to the cooling operation or the heating operation to each sub air conditioning system 4 having the 2-way air conditioning system 7 and the 3-way air conditioning system 8 through the main communication line 3 all together (or concurrently). Therefore, the air conditioning operations of the indoor units 25, 26 for the multiple air conditioning system 1 for buildings can be collectively switched all together (concurrently).

Furthermore, according to this embodiment, a day on which the air conditioning operation is switched to the cooling operation or the heating operation can be registered. Therefore, by registering turn of the seasons or the like in advance, the air conditioning operations of the indoor units can be switched all together on that day.

Still furthermore, according to this embodiment, the indoor units 25, 26 to be excluded from the air condition switching targets can be registered, and thus a desired operation can be continued for a specific room without switching the air conditioning operation of the specific room.

Particularly, the exclusion setting of the indoor units 25, 26 can be performed every outdoor unit 15 of the 2-way air conditioning system 7 or every indoor unit group of the 3-way air conditioning system 8. Furthermore, the installation place of each indoor unit 25, 26 can be checked, and thus only the indoor unit 25, 26 of a desired room can be efficiently excluded from the air condition switching targets.

Furthermore, at least one of the air condition settings such as the setting temperature of the indoor units 25, 26, the setting of the air flow velocity, the setting of the air flow direction, the setting of the concentrated control mode can be registered, and thus the air conditioning settings can be collectively reflected to each indoor unit 25, 26 when the air conditioning operation is switched.

The present invention is not limited to the above embodiment, and various modifications and applications may be made without departing from the subject matter of the present invention.

What is claimed is:

1. An air conditioning system comprising:

at least one first air conditioning system in which an outdoor unit is connected to plural indoor units through an inter-unit pipe and the plural indoor units are allowed to execute one of cooling operation and heating operation concurrently;

at least one second air conditioning system in which an outdoor unit is connected to plural indoor units through an inter-unit pipe and the plural indoor units are allowed to execute both cooling operation and heating operation in mixture concurrently; and a controller that is connected to the first and second air conditioning systems through a communication line so that communications can be performed between the controller and each of the first and second air conditioning systems, wherein the controller transmits a switching instruction signal for instructing switching of an air conditioning operation to cooling operation or heating operation through the communication line to the first and second air conditioning systems all together, wherein the switching instruction signal from the controller is transmitted through communication line to the respective outdoor units or an outdoor unit functioning as a master unit of the first air conditioning system and the respective indoor units of the second air conditioning system, and on the basis of the switching signal, air conditioning operations of the indoor units in the first air conditioning system are concurrently switched to the heating operation or the cooling operation through a switching operation of a four-way valve provided to each of the outdoor units and air conditioning operations of the indoor units in the second air conditioning system are concurrently switched to the heating operation or the cooling operation through an opening/closing operation of a first opening/closing valve and a second opening/closing valve provided to each of the indoor units so that the heating operation and the cooling operation are mixed with each other.

2. The air conditioning system according to claim 1, wherein the controller is equipped with a date registering unit for registering, on the controller, a date at which the switching instruction signal is transmitted to switch the air conditioning operation to cooling operation or heating operation.

3. The air conditioning system according to claim 1, wherein the controller is equipped with an exclusion unit registering unit for registering, on the controller, indoor units to be excluded from target units of the first and second air conditioning systems which should be subjected to the air condition switching to cooling operation or heating operation on the basis of the switching instruction signal.

4. The air conditioning system according to claim 1, wherein the air conditioning system has a plurality of first air conditioning systems, and the controller is equipped with a registering unit for registering, on the controller, first air conditioning systems to be excluded from target air conditioning systems which should be subjected to the air condition switching to cooling operation or heating operation on the basis of the switching instruction signal, every outdoor unit of the first air conditioning system.

5. The air conditioning system according to claim 1, wherein the controller is equipped with a storage unit for storing a plurality of indoor unit groups achieved by dividing the indoor units of the second air conditioning system every plural indoor units, and a registering unit for registering, on the controller, indoor unit groups to be excluded from target indoor unit groups which should be subjected to the air condition switching to cooling operation or heating operation on the basis of the switching instruction signal, every indoor unit group.

6. The air conditioning system according to claim 1, wherein the controller is equipped with a storage unit for storing an installation place of each indoor unit of the first and second air conditioning systems in advance, and a registering unit for registering, on the controller on the basis of the installation place, an indoor unit to be excluded from target indoor units which should be subjected to the air conditioning switching to cooling operation or heating operation on the basis of the switching instruction signal.

7. The air conditioning system according to claim 1, wherein the controller is equipped with a registering unit for registering on the controller at least one setting value of setting temperature, an air flow velocity, air flow direction and a concentrated control mode of each indoor unit, and the controller reflects the setting value to each indoor unit when the air conditioning operation is switched to the heating operation or the cooling operation.

8. A controller for an air conditioning system including:

at least one first air conditioning system in which an outdoor unit is connected to plural indoor units through an inter-unit pipe and the plural indoor units are allowed to execute one of cooling operation and heating operation concurrently, and at least one second air conditioning system in which an outdoor unit is connected to plural indoor units through an inter-unit pipe and the plural indoor units are allowed to execute both cooling operation and heating operation in mixture concurrently, wherein the controller is connected to the first and second air conditioning systems through a communication line so that communications can be performed between the controller and each of the first and second air conditioning systems, and transmits a switching instruction signal for instructing switching of an air conditioning operation to cooling operation or heating operation through the communication line to the first and second air conditioning systems all together, said switching instruction signal from the controller is transmitted through communication line to the respective outdoor units or an outdoor unit functioning as a master unit of the first air conditioning system and the respective indoor units of the second air conditioning system, and on the basis of the switching signal, air conditioning operations of the indoor units in the first air conditioning system are concurrently switched to the heating operation or the cooling operation through a switching operation of a four-way valve provided to each of the outdoor units and air conditioning operations of the indoor units in the second air conditioning system are concurrently switched to the heating operation or the cooling operation through an opening/closing operation of a first opening/closing valve and a second opening/closing valve provided to each of the indoor units so that the heating operation and the cooling operation are mixed with each other.

* * * * *